US011008146B2

(12) United States Patent
Chen et al.

(10) Patent No.: US 11,008,146 B2
(45) Date of Patent: May 18, 2021

(54) EASY-PEEL LAMINATED FOOD CAN

(71) Applicant: GUANGZHOU JORSON FOOD TECHNOLOGY CO., LTD., Guangzhou (CN)

(72) Inventors: Jiawen Chen, Guangzhou (CN); Haishan Chen, Guangzhou (CN)

(73) Assignee: GUANGZHOU JORSON FOOD TECHNOLOGY CO., LTD., Guangzhou (CN)

( * ) Notice: Subject to any disclaimer, the term of this patent is extended or adjusted under 35 U.S.C. 154(b) by 4 days.

(21) Appl. No.: 16/474,899

(22) PCT Filed: Dec. 25, 2017

(86) PCT No.: PCT/CN2017/118369

§ 371 (c)(1),
(2) Date: Jun. 28, 2019

(87) PCT Pub. No.: WO2018/121483

PCT Pub. Date: Jul. 5, 2018

(65) Prior Publication Data

US 2019/0344947 A1 Nov. 14, 2019

(30) Foreign Application Priority Data

Dec. 28, 2016 (CN) ..... 201611236852.6

(51) Int. Cl.
*B65D 77/20* (2006.01)
*B65D 65/40* (2006.01)

(52) U.S. Cl.
CPC ..... *B65D 77/2096* (2013.01); *B65D 65/40* (2013.01)

(58) Field of Classification Search
CPC ..... B65D 77/2096; B65D 2517/0082; B65D 2517/5032; B65D 2543/00425;
(Continued)

(56) References Cited

U.S. PATENT DOCUMENTS 4,693,385 A * 9/1987 Lamping ..... B65D 77/2024 215/232
4,917,260 A * 4/1990 Heyes ..... B65D 17/507 220/270

(Continued)

FOREIGN PATENT DOCUMENTS

CH 700284 A2 7/2010
CN 1321577 A 11/2001

(Continued)

OTHER PUBLICATIONS

Yang Wenliang, "Manufacturing Technology of Metal Tubes", Metal Can Manufacturing Technology, Oct. 31, 2009, Printing Industry Press, pp. 125-133.

(Continued)

*Primary Examiner* — Shawn M Braden
(74) *Attorney, Agent, or Firm* — Rimon PC

(57) ABSTRACT

An easy-peel laminated food can, comprising a can body (100) made by punching a laminated metal sheet, and a cover body (200) made of a laminating film. The can body (100) comprises a cavity (110) provided with an opening (112) and an annular bonding body (120) circumferentially arranged at the edge of the opening (112), and the cover body (200) and the annular bonding body (120) may be thermally pressed and bonded to be sealed.

9 Claims, 3 Drawing Sheets

(58) Field of Classification Search
CPC ..... B65D 2577/2025; B65D 33/22; B65D 77/2024; B65D 77/2032; B65D 65/40
See application file for complete search history.

(56) References Cited

U.S. PATENT DOCUMENTS

| | | | | |
|---|---|---|---|---|
| 4,946,063 | A * | 8/1990 | Heyes | B21D 51/44 220/270 |
| 4,953,550 | A | 9/1990 | Dunshee | |
| 4,962,849 | A * | 10/1990 | Anderson | B65D 77/2096 206/45.24 |
| 5,011,006 | A * | 4/1991 | Anderson | B65D 77/2096 206/45.23 |
| 5,093,208 | A * | 3/1992 | Heyes | B32B 15/18 428/623 |
| 5,228,588 | A * | 7/1993 | Aizawa | B21D 51/26 220/62.22 |
| 5,375,698 | A * | 12/1994 | Ewart | A45C 11/005 206/205 |
| 5,582,319 | A * | 12/1996 | Heyes | B32B 27/36 220/62.22 |
| 5,759,650 | A * | 6/1998 | Raines | A23L 3/3427 428/35.7 |
| 5,765,710 | A | 6/1998 | Bergerioux | |
| 5,782,375 | A * | 7/1998 | McHenry | B21D 51/26 220/62.12 |
| 6,523,713 | B1 * | 2/2003 | Helms | B65D 51/20 220/831 |
| 6,960,392 | B2 | 11/2005 | Le Du et al. | |
| 8,210,377 | B2 * | 7/2012 | Martin | B65D 41/16 215/349 |
| 2002/0110290 | A1 | 8/2002 | Gebhart | |
| 2009/0061133 | A1 * | 3/2009 | Kojima | B32B 1/02 428/35.8 |
| 2010/0147724 | A1 * | 6/2010 | Mitra-Shah | B65D 75/5833 206/459.1 |
| 2011/0000917 | A1 * | 1/2011 | Wolters | B65D 77/2024 220/376 |
| 2011/0127268 | A1 * | 6/2011 | Boehler | B65D 21/0213 220/359.4 |
| 2012/0037669 | A1 | 2/2012 | Goetz et al. | |
| 2012/0193360 | A1 * | 8/2012 | Deltour | B65D 17/502 220/260 |
| 2014/0263323 | A1 * | 9/2014 | Thorstensen-Woll | B65D 17/501 220/258.3 |
| 2015/0144636 | A1 | 5/2015 | Zong et al. | |
| 2015/0367990 | A1 * | 12/2015 | Sinha | B65D 77/2096 206/459.5 |
| 2016/0159547 | A1 | 6/2016 | Huffer et al. | |

FOREIGN PATENT DOCUMENTS

| | | | |
|---|---|---|---|
| CN | 201030976 | Y | 3/2008 |
| CN | 201816821 | U | 5/2011 |
| CN | 102348398 | A | 2/2012 |
| CN | 202295721 | U | 7/2012 |
| CN | 202449389 | U | 9/2012 |
| CN | 102849324 | A | 1/2013 |
| CN | 104858335 | A | 8/2015 |
| CN | 105109789 | A | 12/2015 |
| CN | 205023065 | U | 2/2016 |
| CN | 205738460 | U | 11/2016 |
| CN | 106628608 | A | 5/2017 |
| CN | 206358618 | U | 7/2017 |
| DE | 2405879 | A1 | 8/1975 |
| GB | 1244339 | A | 8/1971 |
| JP | H01039936 | B2 | 8/1989 |
| TW | 249791 | B | 6/1995 |
| TW | 592969 | B | 6/2004 |
| TW | I260270 | B | 8/2006 |
| TW | M301018 | U | 11/2006 |
| TW | 200716456 | A | 5/2007 |
| TW | 201630725 | A | 9/2016 |
| WO | 2009148988 | A2 | 12/2009 |

OTHER PUBLICATIONS

The State Intellectual Property Office of People's Republic of China, 1st Office Action for Application No. CN201611236852.6 dated Apr. 3, 2018.

The State Intellectual Property Office of People's Republic of China, International Search Report of International Patent Application No. PCT/CN/2017/118369 dated Mar. 30, 2018 (English translation).

European Patent Office, EPO Examination Report of EP Application No. 17888000.1 dated on May 26, 2020.

Taiwan Office Action for Application No. TW106146118 dated Aug. 15, 2018.

International Search Report for International Application No. PCT/CN2017/118369 dated Mar. 30, 2018.

Taiwan Office Action for Application No. TW106146118 dated Aug. 15, 2018. (have to put this in efs format).

The State Intellectual Property Office of People's Republic of China, Office Action for Application No. CN201611236852.6 dated Nov. 1, 2018.

The State Intellectual Property Office of People's Republic of China, Office Action for Application No. CN201611236852.6 dated Feb. 25, 2019.

* cited by examiner

EASY-PEEL LAMINATED FOOD CAN

This application is the National Stage of International Application No. PCT/CN2017/118369, filed 28 Dec. 2017, which claims priority to Chinese patent application No. 201611236852.6 filed Dec. 28 2016, the disclosures of all of which are incorporated by reference herein in their entirety.

TECHNICAL FIELD

The present disclosure relates to the field of food can technology, particularly to a laminated food easy-peel-off can.

BACKGROUND

Currently, the metal food cans are sealed in a manner of double seaming, whether they are two-piece cans or three-piece cans, or their lids are easy-open lids, easy-peel-off lids, or common lids. Therefore, the strength of the can bodies can be increased to ensure that the contents would not be contaminated by secondary pollution. However, there are some disadvantages as described below in the manner of double seaming for sealing: the sealing machines are complicated and difficult to be adjusted, so skilled technicians are required to operate them, and metal lids and cover rings are needed when sealing, which result in high production cost of metal cans; it is easy to cut consumer's fingers during opening the sealing.

SUMMARY

Accordingly, it is necessary to provide a laminated food easy-peel-off can, which can reduce the production cost of the metal food can, and can be opened easily and safely.

Its technical solutions are as follows:

A laminated food easy-peel-off can comprises a can body drawn from a laminated metal sheet and a lid drawn from a laminated metal sheet. The can body comprises a cavity having an opening, and an annular bonding body located around an edge of the opening. The lid is capable of being thermally bonded and sealed to the annular bonding body.

When using the above-mentioned laminated food easy-peel-off can to package food, the food to be packaged is firstly placed into the cavity of the can body, then the can body is covered by the lid, and then a laminated film of the lid and a laminated film of a upper surface of the annular bonding body are bonded together by thermally pressing technology, such that the lid seals the cavity so as to seal and preserve the food. At the same time, the surface of the can body is covered by a laminated film, which can prevent the food from contacting the metal of the can body, thereby avoiding the corrosion and damage to the can body and wasting food. When the preserved food needs to be taken out, the lid can be separated from the annular bonding body by simply peeling off the lid, and then the food can be taken out from the cavity. The sealing of the above-mentioned laminated food easy-peel-off can is able to obtain a tight sealing by bonding the lid to the annular bonding body by heating and pressing, which makes the sealing machine simple and easy to be used, and easy to be operated. Compared with the easy-peel-off lid, the cover ring is omitted, and the production cost of the metal food can is greatly reduced. At the same time, this sealing design can meet the sealing requirements of the metal can bodies in various different shapes, and meet the individual design requirements.

The technical solutions are further described below:

In one embodiment, the lid is thermally bonded and sealed to the annular bonding body, and the lid and the annular bonding body cooperatively form a sealed storage chamber with the cavity.

In one embodiment, a temperature at which the lid and the annular bonding body are thermally bonded and sealed is 130° to 250°.

In one embodiment, an adhesive force of the thermally bonding between an edge of the lid and the annular bonding body is greater than or equal to 120 kpa.

In one embodiment, an edge of the annular bonding body is provided with a smooth transitional scratch-resistant portion.

In one embodiment, the scratch-resistant portion is curled in a direction toward the cavity or away from the cavity, and forms an annular protrusion.

In one embodiment, the cross section of the annular protrusion is in a circular shape.

In one embodiment, the lid is provided with an opening portion located outside a thermally bonded position between the lid and the annular bonding body.

In one embodiment, the annular bonding body and the cavity are perpendicular or approximately perpendicular to each other in a same cross section.

In one embodiment, the annular bonding body is provided with a first laminated film, the lid is provided with a second laminated film, and the lid is bonded and sealed to the annular bonding body by thermal bonding between the second laminated film and the first laminated film.

In one embodiment, the can body is a laminated iron can body or a laminated aluminum can body, and the lid is an aluminum plastic laminated lid or a multi-layer plastic laminated lid.

DESCRIPTION OF REFERENCE SIGNS

Figure 1:
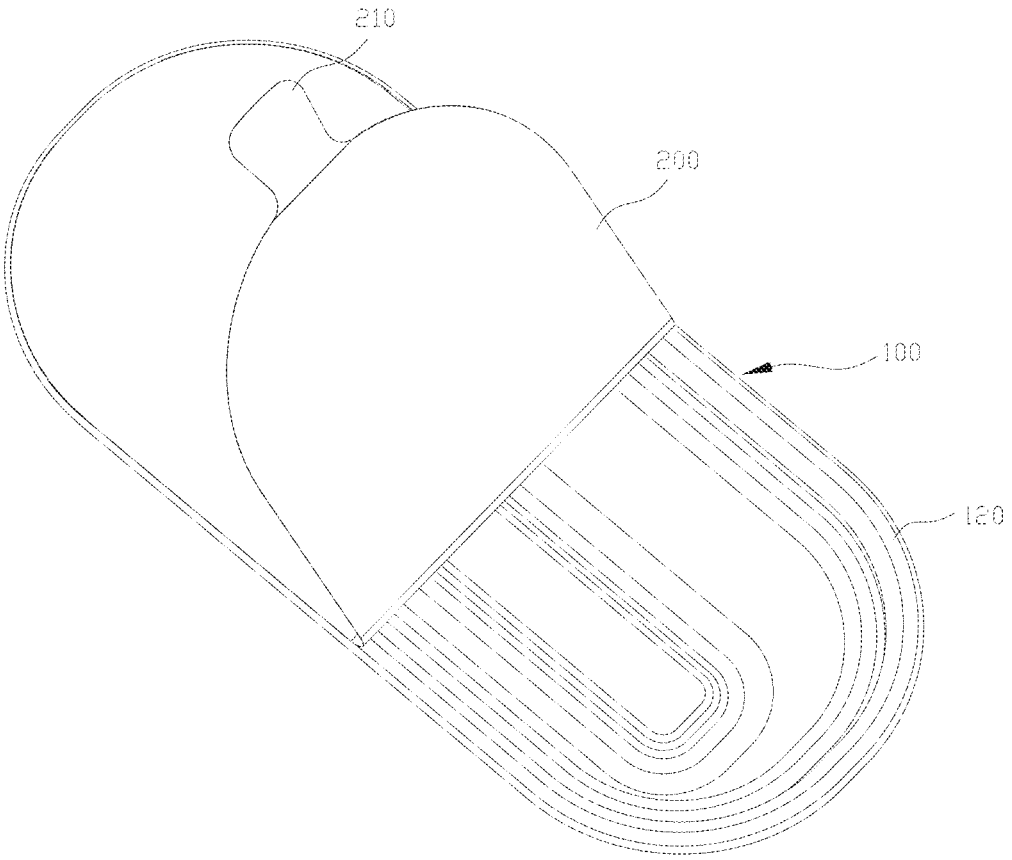
FIG. 1 is a schematic view of a first embodiment of a laminated food easy-peel-off can according to the present disclosure.
Figure 2:
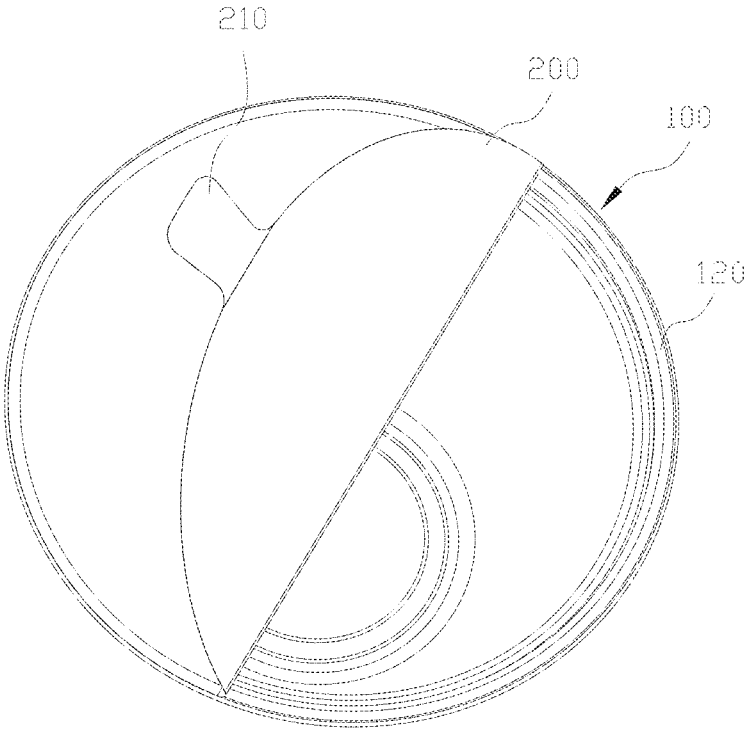
FIG. 2 is a schematic view of a second embodiment of a laminated food easy-peel-off can according to the present disclosure.
Figure 3:
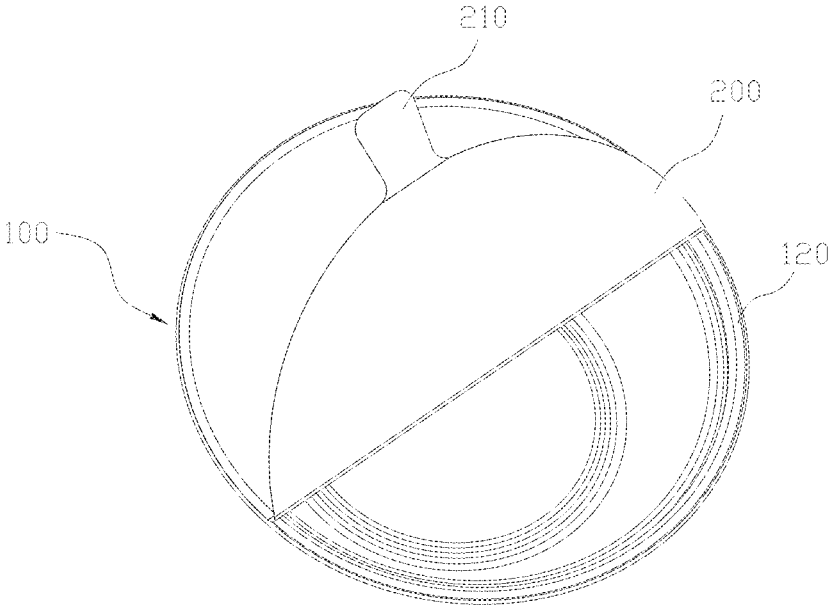
FIG. 3 is a schematic view of a third embodiment of a laminated food easy-peel-off can according to the present disclosure.

100, can body. 110, cavity. 112, opening. 120, annular bonding body. 122, first laminated film. 130, scratch-resistant portion. 200, lid. 210, opening portion. 220, second laminated film.

DETAILED DESCRIPTION OF EMBODIMENTS

In order to make the objects, technical solutions and advantages of the present disclosure more clear, the present disclosure will be further described in detail below with reference to the drawings and specific embodiments. It should be understood that the specific embodiments described herein are merely illustrative of the present disclosure and are not intended to limit the scope of the disclosure.

It should be noted that the "can body" is made from a laminated metal sheet. The laminated metal sheet is formed by attaching a plastic film to a metal sheet by thermally pressing at a high temperature. For example, a PET PC, PE or PP film is attached to the metal sheet (such as tin plate, chrome plate, cold rolled plate, aluminum plate). "thermally bonded" means bonding by heating and pressing.

Unless otherwise specified, all terms (including technical and scientific terms) used herein have the same meaning as commonly understood by those skilled in the art to which this disclosure belongs. The terms used herein is for the purpose of describing embodiments only and is not intended to limit the present disclosure. As used herein, the term "and/or" includes any and all combinations of one or more of the associated listed items.

The terms "first" and "second" in the present disclosure do not represent a specific number and order, but are merely used for distinguishing names.

As shown in FIG. 1 to FIG. 4, a laminated food easy-peel-off can according to the present disclosure comprises a can body 100 drawn from a laminated metal sheet and a lid 200 made of a laminated material. The can body 100 comprises a cavity 110 having an opening 112, and an annular bonding body 120 located around an edge of the opening 112. The lid 200 can be thermally bonded and sealed to the annular bonding body 120.

As shown in FIG. 1 to FIG. 5. When using this laminated food easy-peel-off to package food, the food to be packaged is firstly placed into the cavity 110 of the can body 100, then the can body is covered by the lid 200, and then a laminated film of the lid 200 and a laminated film of a upper surface of the annular bonding body 120 are bonded together by thermally pressing technology, such that the lid 200 seals the cavity 110 so as to seal and preserve the food. At the same time, the surface of the can body 100 is covered by a laminated film, which can prevent the food from contacting the metal of the can body 100, thereby avoiding the corrosion and damage to the can body 100 and wasting food. When the preserved food needs to be taken out, the lid 200 can be separated from the annular bonding body 120 by simply peeling off the lid 200, and then the food can be taken out from the cavity 100. The sealing of the above-mentioned laminated food easy-peel-off can is able to obtain a tight sealing by bonding the lid 200 to the annular bonding body 120 by heating and pressing, which makes the sealing machine simple and easy to be used, and easy to be operated. Compared with the easy-peel-off lid, the cover ring is omitted, and the production cost of the conventional metal food can is greatly reduced. At the same time, this sealing design can meet the sealing requirements of the can bodies 100 in various different shapes, and meet the individual design requirements.

As shown in FIG. 1 to FIG. 5, in this embodiment, the lid 200 is thermally bonded and sealed to the annular bonding body 120, and the lid 200 and the annular bonding body 120 cooperatively form a sealed storage chamber with the cavity. A tight sealing is formed by thermally pressing and bonding technology, which is convenient to form the storage chamber for sealing and storing food and is convenient to preserve food. Preferably, in order to obtain a better adhesive force, a temperature at which the lid and the annular bonding body are thermally bonded and sealed is 130° to 250°. Further, an adhesive force of the thermally bonding between an edge of the lid 200 and the annular bonding body 120 is greater than or equal to 98 kpa. Therefore, it can be used for preserving solid food, and the sealing of the can body 100 is also implemented. Furthermore, the adhesive force of the thermally bonding between the edge of the lid 200 and the annular bonding body 120 is greater than or equal to 120 kpa. That is, after being subjected to a pressure of 120 kpa, the sealing between the edge of the lid 200 and the annular bonding body 120 are still reliably. Therefore, it can be used for preserving liquid food. It has temperature resistance and pressure resistance, thus it can meet the requirements of high pressure sterilization of canned food. The laminated food easy-peel-off can according to the present disclosure is subjected to a pressure test after being cooked at a high temperature of 121° C., and has no leakage at a pressure of 120 kpa. The lid 200 is made of laminated material, preferably, it is made of laminated plastic film having good plasticity and good weldability, such as an aluminum-plastic lamination, a multi-layer plastic lamination, etc.

As shown in FIG. 3 to FIG. 6, preferably, the outer edge of the opening 112 is used to secure the annular bonding body 120. Therefore, the sealing machine is further simplified, and it is more convenient to realize the thermally bonding and sealing between the annular bonding body 120 and the lid 200. Further, the annular bonding body 120 is provided with a first laminated film 122, the lid 200 is provided with a second laminated film 220, and the lid 220 is bonded and sealed to the annular bonding body 120 by thermal bonding between the second laminated film 220 and the first laminated film 122. The tight sealing is formed by thermally bonding between the second laminated film 220 and the first laminated film 122, thereby improving the adhesive force between the lid 200 and the annular bonding body 120. Furthermore, the annular bonding body 120 and the cavity 110 are perpendicular or approximately perpendicular to each other in the same cross-section, so as to facilitate fixing the annular bonding body 120 on the sealing machine and thermally bonding the annular bonding body 120 to the lid 200, and the cavity 100 can be sealed by using a simple sealing machine, which can further reduce the production cost of the metal food can. At the same time, it can prevent that the bonding position between the annular bonding body 120 and the lid 200 is stable and flat, and the lid 200 is prevented from being subjected to an additional pulling force. At the same time, a smooth transitional portion is provided between the annular bonding body 120 and the cavity 110, so that the protrusion or acute angle can be avoided, which may result in an unstable bonding between the lid 200 and the annular bonding body 120. Preferably, the cavity is integrally drawn with the annular bonding body.

Figure 4:
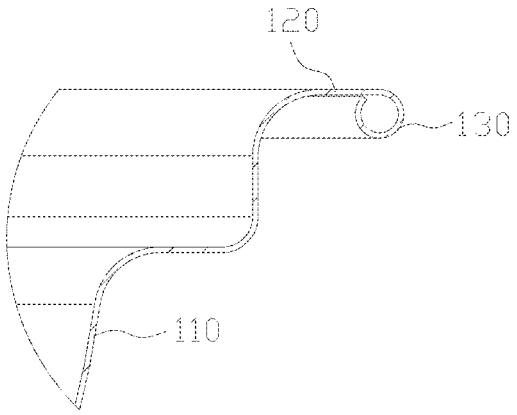
FIG. 4 is a partial, enlarged schematic view of a can body according to the present disclosure.
Figure 5:
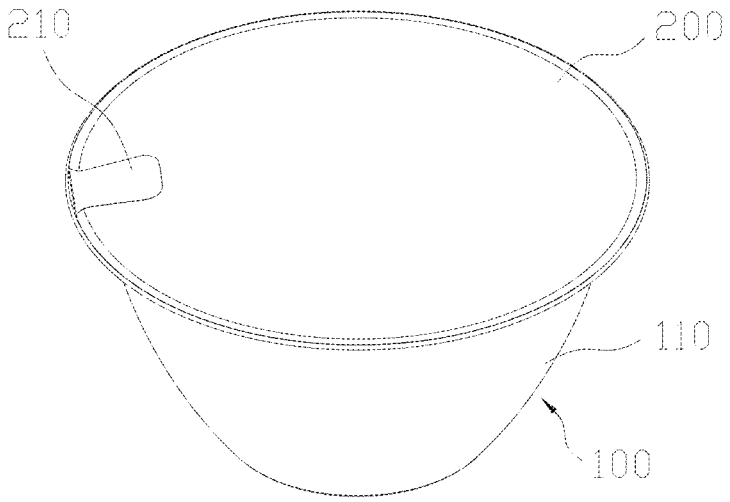
FIG. 5 is a schematic view showing a sealing of a laminated food easy-peel-off can according to the present disclosure.
Figure 6:
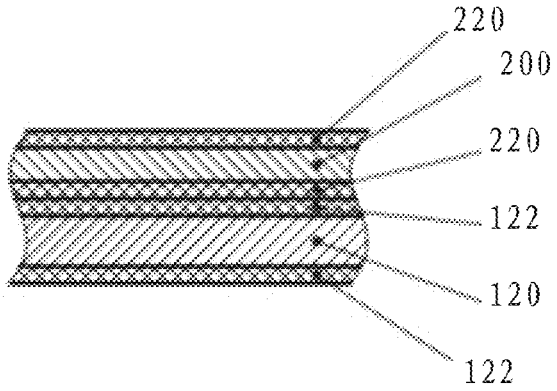
FIG. 6 is a schematic cross-sectional view showing a partial sealing of a laminated food easy-peel-off can according to the present disclosure.

As shown in FIG. 4, in this embodiment, an edge of the annular bonding body 120 is provided with a smooth transitional scratch-resistant portion 130. Therefore, it is possible to prevent the edge of the annular bonding body 120 from cutting the consumer's fingers. Further, the scratch-resistant portion 130 is curled in a direction toward the cavity 110 or away from the cavity 110, and forms an annular protrusion. Therefore, the edge notch of the annular bonding body 120 can be curled inwardly to avoid cutting the fingers due to its exposure. At the same time, the annular protrusion is formed, which is convenient for people to carry and take the can body 100 (for example, after being cooked at a high temperature, the can body 100 can be taken out from the heating position by person holding the annular bonding body 120). Furthermore, the cross-section of the annular protrusion is in a circular shape, so that only the curling process is required to form the scratch-resistant portion 130 during the outer edge processing of the annular bonding body 120.

As shown in FIG. 1, FIG. 2, FIG. 3 or FIG. 5, in this embodiment, the lid 200 is provided with an opening portion 210, which is located outside a thermally bonded position between the lid 200 and the annular bonding body 120. It is convenient for people to peel off the lid 200.

In this embodiment, the can body 100 is a laminated iron can body or a laminated aluminum can body, and the lid 200 is an aluminum plastic laminated lid or a multi-layer plastic laminated lid. Therefore, the can body 100 has sufficient rigidity, the lid 200 has sufficient ductility, and the two are matched to obtain an optimum effect.

Accordingly, the present invention has the following beneficial effects:

1. Metal food can is used as container for food packaging. The metal container is more dense than plastic container. Plastic has oxygen permeability which makes food oxidized and odorous, and the internal food flavor is also easily lost, therefore the shelf life is generally less than one year. By contrast, the metal has good barrier property, the external oxygen cannot get in, the internal flavor will not be lost, and the shelf life is more than two years. However, it is difficult for metal container to be welded and sealed after being packaged with food. At present, sealing in a manner of double seaming is generally popular. However, the laminated food easy-peel-off can according to the present disclosure can be bonded and sealed, and has high barrier property of the metal container, thereby providing a new packaging technology for various canned foods.

2. The sealing of the laminated food easy-peel-off can is able to obtain a tight sealing by bonding the lid to the annular bonding body by heating and pressing, which makes the sealing machine simple and easy to be used, and easy to be operated. The production cost of the metal food can is greatly reduced.

3. The bonded sealing is adopted, which can meet the sealing requirements of the metal can bodies in various different shapes, and meet the individual design requirements.

4. At the same time, the lid does not produce sharp or burr edges during the process of tearing off the lid, and thus the consumer's fingers would not be cut.

All of the technical features in the above embodiments may be employed in arbitrary combinations. For purpose of simplifying the description, not all arbitrary combinations of the technical features in the above embodiments are described. However, as long as such combinations of the technical features are not contradictory, they should be considered as within the scope of the disclosure in this specification.

The above embodiments merely represent several embodiments of the present disclosure, and the description thereof is more specific and detailed, but they should not be construed as limiting the scope of the disclosure. It should be noted that for those skilled in the art, several variations and improvements may be made without departing from the concept of the present disclosure. And these are all within the protection scope of the present disclosure. Therefore, the scope of protection of the present disclosure shall be subject to the appended claims.

What is claimed is:

1. A laminated food easy-peel-off can, comprising a can body made of a laminated metal sheet and a lid made of a laminated material, the can body comprising a cavity having an opening, and an annular bonding body located around an edge of the opening and being thermally bondable to the lid, and the lid being thermally bondable with the annular bonding body to form a sealed connection with the can body, wherein the can body is a laminated iron can body while the lid is an aluminum plastic laminated lid or a multi-layer plastic laminated lid, and wherein the annular bonding body is provided with a first laminated film, the lid is provided with a second laminated film, the lid is bonded and sealed to the annular bonding body by directly thermal bonding the second laminated film to the first laminated film.

2. The laminated food easy-peel-off can according to claim 1, wherein the lid is thermally bonded and sealed to the annular bonding body, the lid and the annular bonding body cooperatively form a sealed storage chamber with the cavity.

3. The laminated food easy-peel-off can according to claim 1, wherein an adhering force of the thermally bonding between an edge of the lid and the annular bonding body is greater than or equal to 120 kpa.

4. The laminated food easy-peel-off can according to claim 1, wherein an edge of the annular bonding body is provided with a smooth transitional scratch-resistant portion.

5. The laminated food easy-peel-off can according to claim 4, wherein the scratch-resistant portion is curled in a direction toward the cavity or away from the cavity, and forms an annular protrusion.

6. The laminated food easy-peel-off can according to claim 1, wherein a smooth transitional portion is provided on an edge of the annular bonding body.

7. The laminated food easy-peel-off can according to claim 1, wherein the lid is provided with an opening portion located outside a thermally bonded position between the lid and the annular bonding body.

8. The laminated food easy-peel-off can according to claim 1, wherein the can body is made of a thermally laminated iron plate which comprises an iron sheet and a plastic film.

9. The laminated food easy peel off can according to claim 1, wherein the laminated film layer inside the can is food contact layer which protect the metal from corrosion.

* * * * *